US008152266B2

(12) United States Patent
Sekiya et al.

(10) Patent No.: US 8,152,266 B2
(45) Date of Patent: Apr. 10, 2012

(54) INKJET RECORDING APPARATUS

(75) Inventors: Yasuhito Sekiya, Chiba (JP); Toshiaki Watanabe, Chiba (JP)

(73) Assignee: SII Printek Inc. (JP)

( * ) Notice: Subject to any disclaimer, the term of this patent is extended or adjusted under 35 U.S.C. 154(b) by 1039 days.

(21) Appl. No.: 11/586,186

(22) Filed: Oct. 25, 2006

(65) Prior Publication Data

US 2007/0097170 A1 May 3, 2007

(30) Foreign Application Priority Data

Oct. 31, 2005 (JP) ..... 2005-316649

(51) Int. Cl.
*B41J 2/165* (2006.01)

(52) U.S. Cl. ..... 347/30

(58) Field of Classification Search ..... None
See application file for complete search history.

(56) References Cited

U.S. PATENT DOCUMENTS 6,312,092 B1 * 11/2001 Usui et al. ..... 347/30
6,935,719 B2 * 8/2005 Yamada ..... 347/29

FOREIGN PATENT DOCUMENTS

EP 1000748 5/2000
EP 1074388 2/2001

OTHER PUBLICATIONS

Patent Abstracts of Japan, publication No. 2002-086746, publication date Mar. 26, 2002.

* cited by examiner

*Primary Examiner* — Matthew Luu
*Assistant Examiner* — Alejandro Valencia
(74) *Attorney, Agent, or Firm* — Adams & Wilks

(57) ABSTRACT

To provide a method of effectively reducing the amount of ink droplets remaining on a nozzle surface after a cleaning operation, and an inkjet recording apparatus capable of shortening an entire processing time of an initial filling operation and a cleaning operation by shortening an ink discharge operation time. By providing a partition wall so that a suction port and an atmosphere opening port provided on a back side of a porous sheet placed in a cap are not directly communicated with each other, in an ink discharge operation in the cap, air having entered through the atmosphere opening port flows through a space between the porous sheet and the nozzle surface, and thereafter, flows to the suction port via the porous sheet. Therefore, ink droplets remaining adhering to the nozzle surface can be removed using the force of air flow.

6 Claims, 6 Drawing Sheets

INKJET RECORDING APPARATUS

BACKGROUND OF THE INVENTION

1. Field of the Invention

The present invention relates to an inkjet recording apparatus that is applied to, for example, a printer and a facsimile to discharge ink from a plurality of nozzles.

2. Related Background Art

Conventionally known is an inkjet recording apparatus for recording a character or an image on a recording medium, using an inkjet head for discharging ink from a plurality of nozzles. In such inkjet recording apparatus, when an ink droplet or dust adheres to the periphery of a nozzle, the flying direction of ink discharged from the nozzles is curved or the like and degrades printing quality. Further, air is mixed in the nozzles to cause a discharge defect, e.g., to make it impossible to discharge ink. Therefore, a cleaning operation is performed for the purpose of removing the air in the nozzles, and the ink droplet or dust at the periphery of the nozzles.

As one cleaning operation, a method of sucking ink from the nozzles using a cap is known. JP 03-61593 B proposes, as a method for this operation, a step of bringing a cap into close contact with a nozzle surface, sucking ink from nozzles by setting an inside of the cap at a negative pressure, subsequently opening the inside of the cap to an atmosphere, discharging ink in the cap, and finally separating the cap from the nozzle surface.

Further, in the above-mentioned cleaning operation of performing suction using a cap, ink pool remains on the nozzle surface when the cap is opened, so that a wiping operation of wiping remaining ink with an elastic material is performed for the purpose of removing the remaining ink. However, the wiping operation is not desirable because the wiping operation is a factor for damaging the nozzle surface, and may be a factor for allowing air or dust to be mixed in the nozzles again.

Further, JP 03-43066 B proposes, as another method of removing remaining ink on a nozzle surface, a method of absorbing remaining ink by capillarity by placing a porous sheet in a cap and bringing the porous sheet close to the nozzle surface.

However, only by the above-mentioned method of bringing a porous sheet close to a nozzle surface, it is difficult to remove remaining ink on the nozzle surface completely, so that the removal ratio of remaining ink is enhanced by performing composite processing of performing a discharge operation of ink in a cap for a long period of time while using the porous sheet, and furthermore, performing a wiping operation and the like. Therefore, there is a demand for simplifying a series of cleaning operations and shortening a time required for processing.

SUMMARY OF THE INVENTION

An object of the present invention is to provide a method of effectively reducing the amount of ink droplets remaining on a nozzle surface after a cleaning operation, and to provide an inkjet recording apparatus capable of shortening the entire processing time of an initial filling operation and a cleaning operation by shortening an ink discharge operation time.

To solve the above-mentioned problem, according to a first aspect of the present invention, there is provided an inkjet recording apparatus, including: an inkjet head for discharging ink from a plurality of nozzles; and a cap capable of being pressed against a nozzle surface of the inkjet head, in which the cap includes: a suction port communicated with negative pressure generation means; an atmosphere opening for returning an inside of the cap to an atmospheric pressure; a porous sheet placed so as to partition a space in the cap into a nozzle surface side space and a cap bottom surface side space; and a partition wall for bisecting the cap bottom surface side space into a suction port side space having the suction port and an atmosphere opening side space having the atmosphere opening.

According to a second aspect of the present invention, there is provided the inkjet recording apparatus according to the first aspect, characterized in that the suction port side space is larger than the atmosphere opening side space.

According to a third aspect of the present invention, there is provided the inkjet recording apparatus according to the first aspect, characterized in that an opening is provided to a part of the porous sheet, and the atmosphere opening side space is communicated with the nozzle surface side space.

According to a fourth aspect of the present invention, there is provided an inkjet recording apparatus, including: an inkjet head for discharging ink from a plurality of nozzles; and a cap capable of being pressed against a nozzle surface of the inkjet head, in which the cap includes: a porous sheet placed so as to partition a space in the cap into a nozzle surface side space and a cap bottom surface side space; an atmosphere opening placed in the nozzle surface side space so as to returning an inside of the cap to an atmospheric pressure; and a suction port placed in the cap bottom surface side space so as to be communicated with negative pressure generation means.

As described above, in the inkjet recording apparatus of the present invention, a partition wall is provided so that a suction port and an atmosphere opening provided on a back side of a porous sheet placed in a cap are not directly communicated with each other. As a result, in an ink discharge operation in the cap, air that enters from the atmosphere opening flows through a space formed between the porous sheet and the nozzle surface, and thereafter flows to a suction port via the porous sheet, so that an ink droplet remaining adhering to the nozzle surface can be removed using the force of an air flow. Furthermore, suction is performed through the porous sheet, so that a uniform flow of air occurs on a nozzle surface.

In addition, ink can be removed forcefully, using the flow of air in addition to the ink absorption by capillarity of a porous sheet, so that the amount of ink droplets remaining on a nozzle surface after a cleaning operation can be reduced remarkably. Furthermore, ink is removed rapidly by the flow of air, so that a time required for an ink discharge operation can be shortened, which makes it unnecessary to perform a wiping operation to be conducted thereafter, or simplifies the wiping operation.

DETAILED DESCRIPTION OF THE PREFERRED EMBODIMENTS

Hereinafter, the present invention will be described in detail by way of an embodiment.

Figure 1:
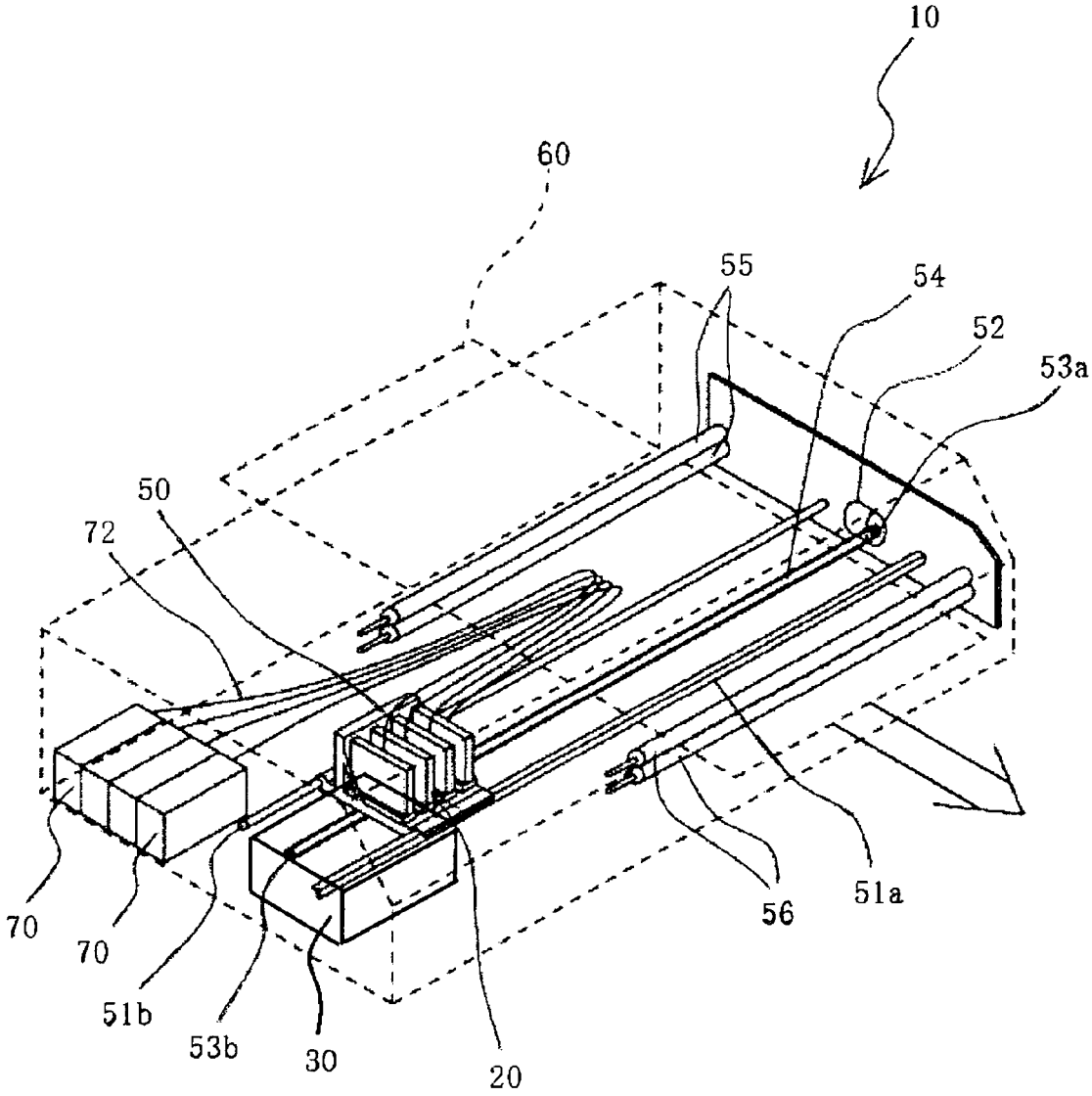
FIG. 1 is a schematic perspective view of an inkjet recording apparatus according to an embodiment of the present invention.

FIG. 1 is a schematic perspective view of an inkjet recording apparatus according to an embodiment of the present invention.

As shown in FIG. 1, an inkjet recording apparatus 10 of this embodiment includes a plurality of inkjet heads 20 provided on a color basis, a carriage 50 on which the plurality of inkjet heads 20 are mounted to be arranged in a main scanning direction, and an ink cartridge 70 that is ink storage means via an ink supply pipe 72 made of a flexible tube, and the carriage 50 is mounted so as to move in an axial direction on a pair of guide rails 51*a* and 51*b*. Furthermore, a driving motor 52 is provided on one end side of the guide rails 51*a* and 51*b*, and a driving force by the driving motor 52 is designed to move along a timing belt 54 hung across a pulley 53*a* connected to the driving motor 52 and a pulley 53*b* provided on the other end side of the guide rails 51*a* and 51*b*.

Furthermore, on both end sides in a direction orthogonal to the transport direction of the carriage 50, a pair of transport rollers 55 and 56 are provided along the guide rails 51*a* and 51*b*. The transport rollers 55 and 56 transport a recording medium 60 in a direction orthogonal to the transport direction of the carriage 50 below the carriage 50.

Then, the carriage 50 is scanned in a direction orthogonal to the feed direction thereof while the recording medium 60 is fed by the transport rollers 55 and 56, thereby recording a character, an image, and the like on the recording medium 60 by the inkjet head 20.

It should be noted that each inkjet head 20 is of a large type discharging monochrome ink, and for example, in this embodiment, four inkjet heads 20 are mounted on the carriage 50 to be arranged corresponding to ink of four colors of black (B), yellow (Y), magenta (M), and cyan (C).

Furthermore, each ink cartridge 70 filled with ink of each color is provided at a position where the ink cartridge 70 does not become an obstacle in the movement of the carriage 50 in a main scanning direction and the movement of the recording medium 60, and at a position lower by a predetermined amount from a nozzle opening of the inkjet head 20 so as to provide a negative pressure in the inkjet head 20.

Figure 2:
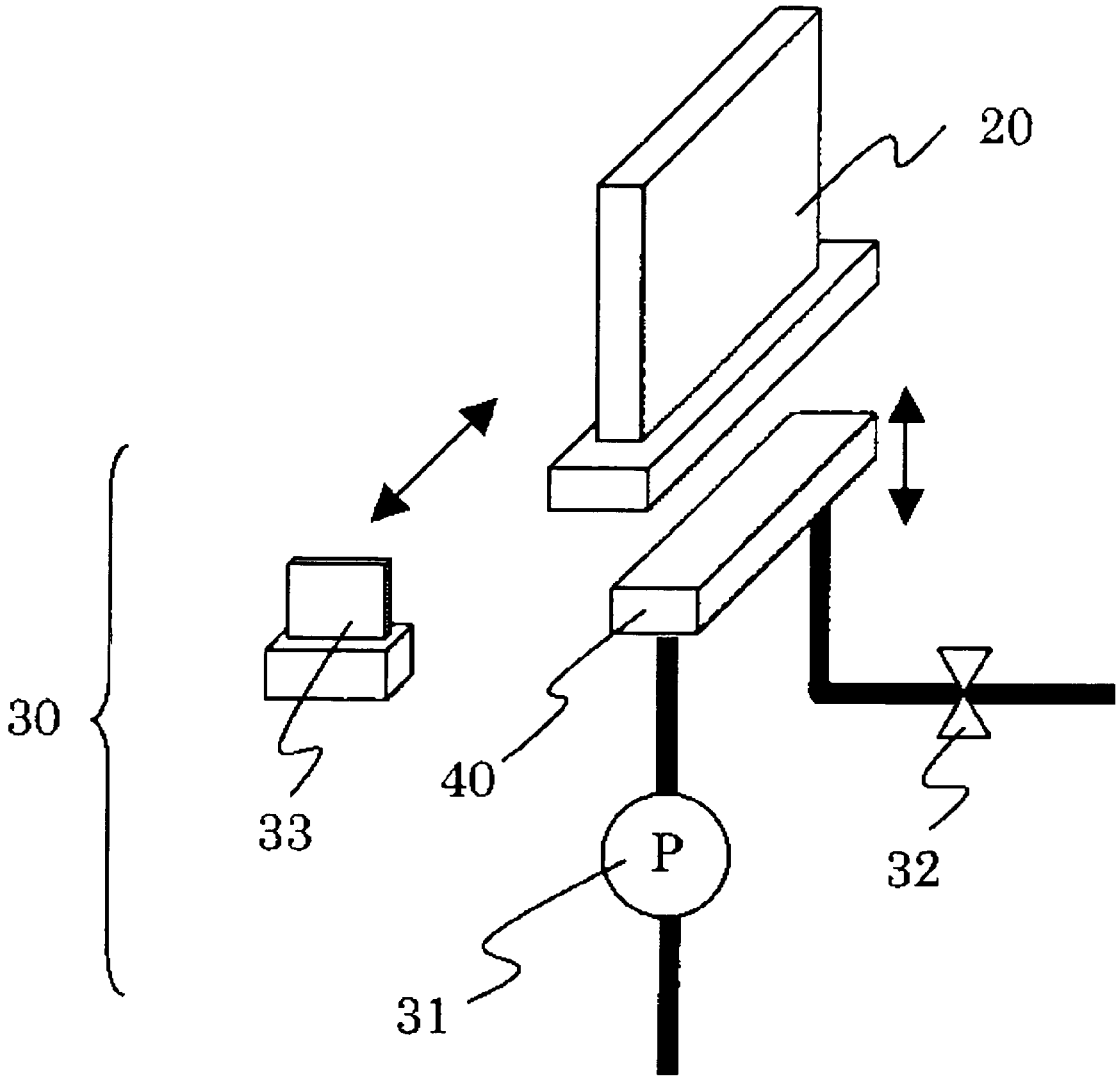
FIG. 2 is a structural view of a maintenance unit according to the embodiment of the present invention.

Furthermore, the inkjet recording apparatus 10 is mounted with a maintenance unit 30 for performing a cleaning operation of the inkjet head 20. FIG. 2 is a structural view of a maintenance unit according to the embodiment of the present invention.

The maintenance unit 30 is composed of a cap 40 capable of covering a nozzle surface 21 of an inkjet head 20, a movement mechanism (not shown) for allowing the cap 40 to perform an up/down operation so that the cap 40 is pressed against the nozzle surface 21, a pump 31 (negative pressure generation means) for generating a negative pressure in the cap 40, an atmosphere opening valve 32 for returning the pressure in the cap 40 to an atmospheric pressure, and a wiper 33 for wiping ink droplets remaining on the nozzle surface 21.

By operating the maintenance unit 30, a nozzle is filled with ink for the first time when the inkjet head 20 is attached, i.e., a so-called initial filling operation is performed. Furthermore, at a time of start-up, at a predetermined timing such as before the commencement of printing, or at an arbitrary timing, a so-called cleaning operation, such as the removal of dust or the like and ink droplets adhering to the nozzle surface 21 of the inkjet head 20, and the recovery of nozzle clogging, is performed.

The initial filling operation and the cleaning operation are performed in the following procedure.

The inkjet head 20 is moved above the maintenance unit 30, and the cap 4*b* is moved upward so as to be pressed against the nozzle surface 21 by a movement mechanism (capping operation). At this time, the atmosphere opening valve 32 is opened so that air is not mixed in the nozzle as a result of pressing of the cap 40. Next, under the condition that the atmosphere opening valve 32 is closed, the pump 31 is operated to set the inside of the cap 40 to be a negative pressure, thereby sucking ink from the nozzle (ink suction operation). The pump 31 is stopped after a predetermined amount of ink is sucked, and this state is held until the negative pressure is alleviated. This is because, if an atmosphere is opened immediately after the pump 31 is stopped, the ink in the cap 40 flows in an opposite direction to a nozzle side, with the result that air and dust may be mixed in the nozzle. Next, the pressure in the cap 40 is returned to an atmospheric pressure by opening the atmosphere opening valve 32 (atmosphere opening operation). Under the condition that the atmosphere opening valve 32 is opened, the pump 31 is operated, and ink remaining in the cap 40 is sucked out (air suction operation). Finally, the wiper 33 is moved under the condition that a wipe tip of the wiper 33 is pressed against the nozzle surface 21, thereby wiping out ink droplets remaining on the nozzle surface 21 (wiping operation).

Figure 3A:
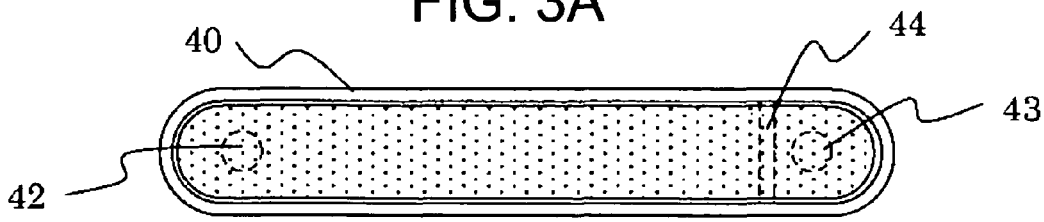
FIGS. 3A-3B are views illustrating an example of a cap configuration according to the embodiment of the present invention.
Figure 3B:
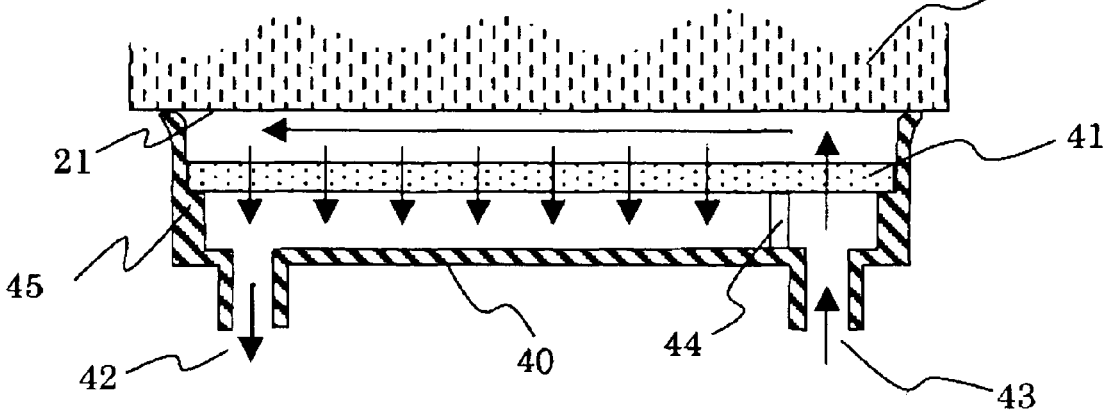
Figure 4A:
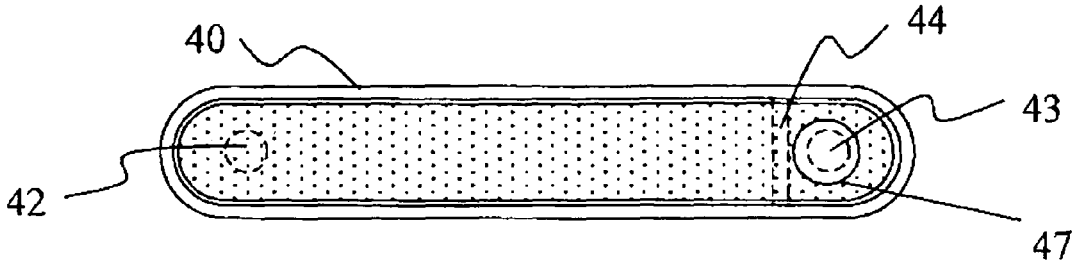
FIGS. 4A-4B are views illustrating another example of a cap configuration according to the embodiment of the present invention.
Figure 4B:
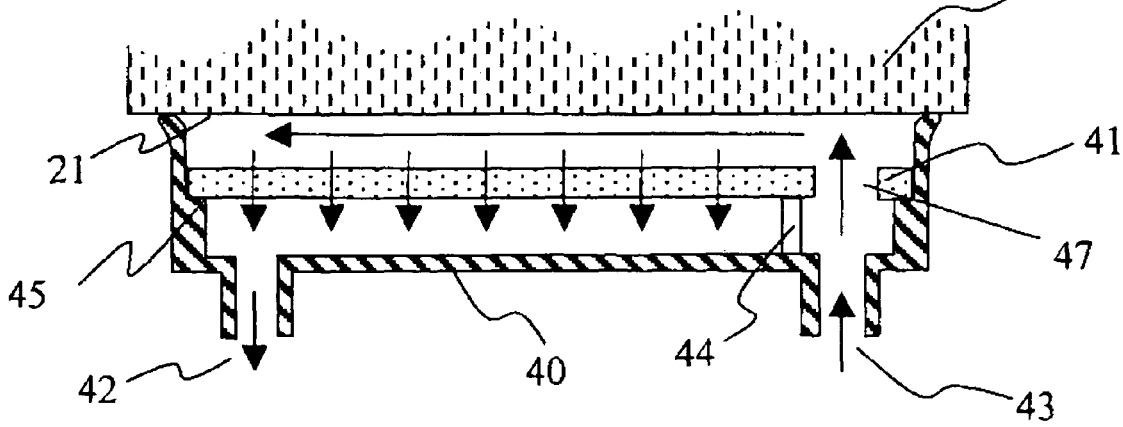

Herein, referring to FIGS. 3A-3B, the configuration of the cap to be mounted in the above-mentioned inkjet recording apparatus will be described. It should be noted that FIG. 3A represents an upper surface of the cap, and FIG. 3B represents a cross-section under the condition that the inkjet head 20 is in close contact with the cap. Arrows of FIG. 3B shows the flow of air at a time of air suction operation.

As shown in the figure, the cap configuration according to this embodiment is provided with a porous sheet 41 placed so as to partition the cap 40 into upper and lower sections, a suction port 42 communicated with the pump 31 for generating a negative pressure in a bottom surface portion of the cap 40, and an atmosphere opening port 43 communicated with the atmosphere opening valve 32. A stepped portion 45 is provided slightly above a center portion of a side wall of the cap 40, and the porous sheet 41 is supported on the stepped portion 45. Because of this, when a capping operation is performed, a slight gap is generated between the porous sheet 41 and the nozzle surface 21 (nozzle surface side space), and a space is also generated between the porous sheet 41 and the bottom surface of the cap 40 (cap bottom surface side space). The porous sheet 41 can suck ink by capillarity when coming into contact with ink droplets remaining on the nozzle surface 21. Furthermore, when the porous sheet is pressed against the nozzle surface 21 too much, the nozzle surface is rather damaged.

Furthermore, in a space between the porous sheet 41 and the bottom surface of the cap 40 (cap bottom surface side space), a partition wall 44 is provided so that the suction port 42 and the atmosphere opening port 43 are not directly communicated with each other. This partition wall 44 partitions the cap bottom surface side space into a suction port side space and an atmosphere opening side space that are completely separated from each other by the partition wall 44.

Owing to such the configuration, the flow of air at the time of air suction operation passes between the porous sheet 41 and the nozzle surface 21, and passes through the porous sheet 41 to flow in the suction port 42 direction, as represented by the arrows shown in FIG. 3B. Because of this, the remaining ink droplets adhering to the nozzle surface can be effectively removed using the force of the air flow.

Furthermore, the partition wall 44 is provided at a position closer to the atmosphere opening port 43, compared with the center of the cap bottom surface side space, so the suction side space becomes larger than the atmosphere opening side space. The flow of air (downward arrows shown in the figure) is formed uniformly over the entire nozzle surface 21, and ink droplets remaining on the nozzle surface 21 can be reduced remarkably. Furthermore, ink is removed rapidly by the flow of air, which shortens the time required for an ink discharge operation, thereby making the wiping operation, which is performed thereafter, unnecessary or simplifying it.

Figure 5A:
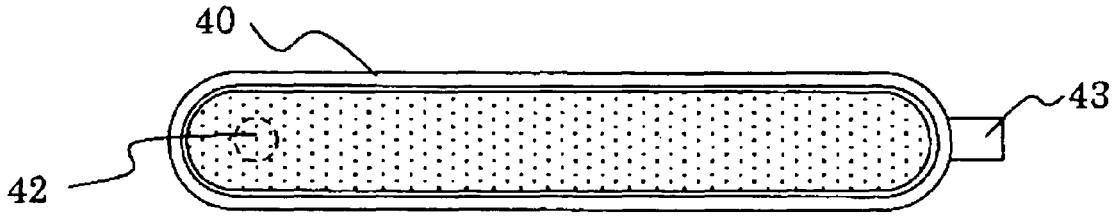
FIGS. 5A-5B are views illustrating a further example of a cap configuration according to the embodiment of the present invention.
Figure 5B:
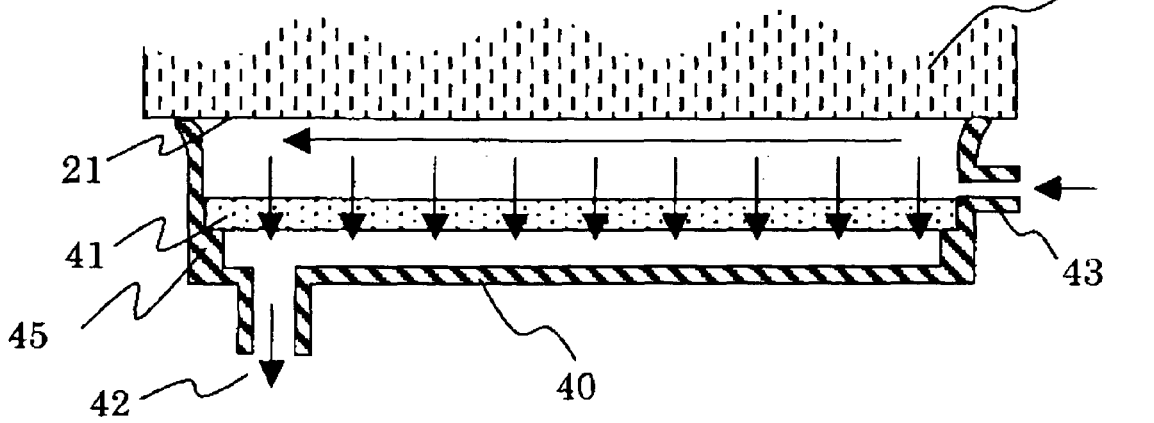

In contrast to the example of FIGS. 3A-3B, FIGS. 4A-4B show an example of a configuration in which an opening portion 47 is provided in the porous sheet 41 above the atmosphere opening port 43, thereby making the flow of air satisfactory at the time of the air suction operation. Furthermore, in contrast to the example of FIGS. 3A-3B, FIGS. 5A-5B show an example of a configuration in which the atmosphere opening port 43 is provided on an upper surface of the porous sheet 41. Even in the examples shown in FIGS. 4A-4B and 5A-5B, the flow of air can be generated between the porous sheet 41 and the nozzle surface 21, so that the effect similar to that of the example shown in FIGS. 3A-3B can be obtained. In addition, in the embodiment shown in FIGS. 5A-5B, compared with the embodiment shown in FIGS. 3A-3B, the flow of air is formed uniformly over the entire nozzle surface 21, and ink droplets remaining on the nozzle surface 21 can be removed more effectively.

Figure 6A:
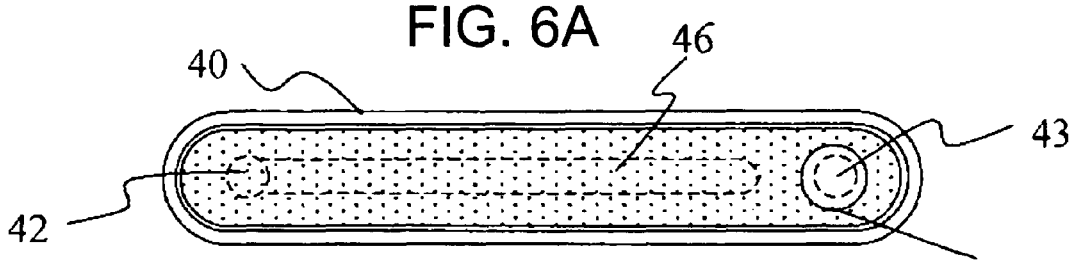
FIGS. 6A-6B are views illustrating another example of a cap configuration according to the embodiment of the present invention.
Figure 6B:
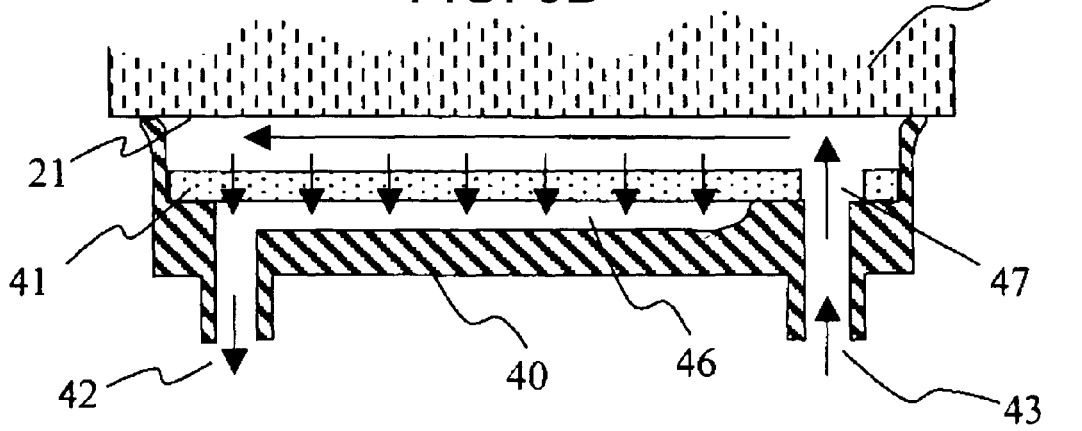

FIGS. 6A-6B show an example in which the suction port side space is formed as a groove portion 46. The same effect of removing remaining ink droplets from the nozzle surface 21 is obtained, and in addition, the flow rate in the suction port side space becomes large owing to the groove shape. Therefore, ink in the suction port side space can also be removed effectively. In FIGS. 6A-6B, the suction port side space is formed in a groove shape in the embodiment shown in FIGS. 5A-5B, but the present invention is not limited thereto, and other embodiments can also be applied similarly.

What is claimed is:

1. An inkjet recording apparatus, comprising:

an inkjet head for discharging ink from a plurality of nozzles; and a cap capable of being pressed against a nozzle surface of the inkjet head, wherein the cap includes:

a suction port communicated with negative pressure generation means;

an atmosphere opening for returning an inside of the cap to an atmospheric pressure;

a porous sheet disposed in a space in the cap and dividing the inside of the cap into a nozzle surface side space and a cap bottom surface side space; and a partition wall that partitions the cap bottom surface side space into a suction port side space having the suction port and an atmosphere opening side space having the atmosphere opening;

wherein the porous sheet separates the atmosphere opening side space and the nozzle surface side space.

2. An inkjet recording apparatus according to claim 1; wherein the suction port side space is larger than the atmosphere opening side space.

3. An inkjet recording apparatus according to claim 1; wherein the partition wall is interposed between opposed surfaces of the porous sheet and the cap bottom.

4. An inkjet recording apparatus according to claim 1; wherein the partition wall completely separates the suction port side space from the atmosphere opening side space.

5. An inkjet recording apparatus according to claim 1; wherein the atmosphere opening opens into the atmosphere opening side space.

6. An inkjet recording apparatus according to claim 1; wherein the porous sheet is supported by a stepped portion of a side wall of the cap.

* * * * *